United States Patent [19]

Sanders

[11] Patent Number: 4,714,858

[45] Date of Patent: Dec. 22, 1987

[54] CAPPED ELECTRIC LAMP COMPRISING A METAL SLEEVE HAVING A CORNER DEPRESSION TO ENGAGE AN ASSOCIATED RECESS IN AN INSULATOR BODY

[75] Inventor: Rudolf Sanders, Eindhoven, Netherlands

[73] Assignee: U.S. Philips Corporation, New York, N.Y.

[21] Appl. No.: 22,472

[22] Filed: Mar. 5, 1987

Related U.S. Application Data

[63] Continuation of Ser. No. 753,210, Jul. 9, 1985, abandoned.

[30] Foreign Application Priority Data

Aug. 17, 1984 [NL] Netherlands ..... 8402524

[51] Int. Cl.[4] ..... H01J 5/48; H01J 5/50

[52] U.S. Cl. ..... 313/318; 313/331; 313/317; 439/611

[58] Field of Search ..... 313/318, 326, 331, 317, 313/315, 82; 339/144 R, 144 T, 145 R, 145 D, 145 T, 146

[56] References Cited

U.S. PATENT DOCUMENTS

| | | | |
|---|---|---|---|
| 2,692,154 | 10/1954 | Wigan | 339/144 R |
| 2,740,370 | 4/1956 | Elmendorf et al. | 339/144 R |
| 3,001,096 | 9/1961 | Mosby | 313/318 |
| 3,093,768 | 6/1963 | Ayres | 339/144 R |
| 3,739,221 | 6/1973 | DeBleyker et al. | 339/144 R |
| 3,746,907 | 7/1973 | Knochel et al. | 313/318 |
| 3,855,495 | 12/1974 | Pappas et al. | 313/318 |
| 3,961,216 | 6/1976 | Edwards | 339/144 R |
| 4,039,886 | 8/1977 | Scherzer | 313/318 |
| 4,092,562 | 5/1978 | Campbell | 313/318 |
| 4,396,860 | 8/1983 | Hellwing et al. | 339/144 R |
| 4,565,944 | 1/1986 | Beurskens et al. | 313/318 |
| 4,567,397 | 1/1986 | Wilhelm et al. | 339/144 R |

*Primary Examiner*—David K. Moore
*Assistant Examiner*—Michael Razavi
*Attorney, Agent, or Firm*—David R. Treacy

[57] ABSTRACT

In certain electric lamps, the lamp cap has a rectangular metal sleeve (10), which is fixed around the pinch (3) of the lamp vessel (1). The sleeve (10) also surrounds an insulator body (12), which immovably encloses a contact member (13). The contact member (13) is secured to a current supply conductor (4) of the lamp. In the lamp according to the invention, the insulator body (12) is immovably held in the sleeve (10) by depressions (16) in the corners (14) of said sleeve, which engage a respective recess in the insulator body (12).

7 Claims, 2 Drawing Figures

Figure 1:
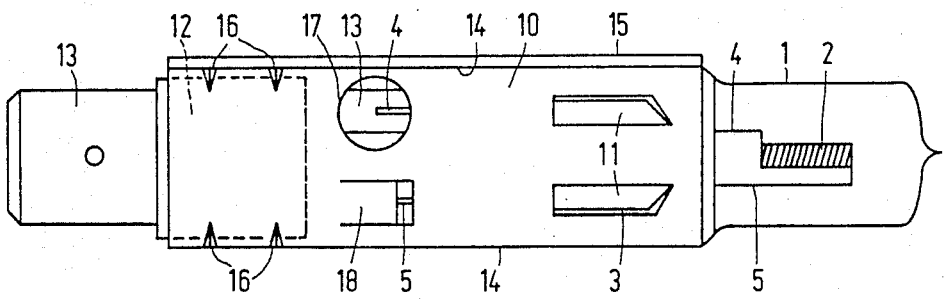

CAPPED ELECTRIC LAMP COMPRISING A METAL SLEEVE HAVING A CORNER DEPRESSION TO ENGAGE AN ASSOCIATED RECESS IN AN INSULATOR BODY

This is a continuation of application Ser. No. 753,210, filed July 9, 1985, now abandoned.

The invention relates to a capped electric lamp comprising a lamp vessel sealed in a vacuum-tight manner in which an electric element is arranged and which is provided with a pinch;

a first and a second current supply conductor, which extend from outside the lamp vessel to the electric element and at least the first of which passes through the pinch;

a metal sleeve having a substantially rectangular cross-section, in which the pinch of the lamp vessel is fixed and in which an insulator body having a substantially rectangular cross-section is enclosed;

a contact member which is connected to the first current supply conductor, and which is immovably enclosed over part of its length by the insulator body and projects at one end from the insulator body and the metal sleeve.

A lamp of this kind, in which the electric element is a filament, is generally known under the designation H-1 and is used in car headlamps.

It has been found that during manipulation of the lamp, such as when securing a contact terminal of a current source to the contact member of the lamp, mechanical forces are exerted on the connection between the first current supply conductor and the contact member, as a result of which this connection may be interrupted or this current supply conductor may break. Obviously, the insulator body and hence the contact member has movement possibilities in the metal sleeve.

The invention has for its object to provide a lamp, in which the insulator body is immovably held in the metal sleeve by simple means.

According to the invention, this object is achieved in an electric lamp of the kind mentioned in the opening paragraph in that the insulator body is immovably held in the metal sleeve by at least one depression in at least one corner of the metal sleeve, the depression engaging a recess of the insulator body.

In order to compensate for accidental influences on the manufacture of the lamp, it is advantageous for each corner of the metal sleeve to have at least one depression engaging a respective recess of the insulator body.

For the sake of clarity, it should be noted that the term "corner" is to be understood to mean the line of intersection of two planes of the metal sleeve, or in other words, the line on which corresponding angular points of cross-sections of the metal sleeve are located.

It is known from German Gebrauchsmuster 8104771 to which published British Patent Application No. 2 093 632A corresponds, to fix an insulator body in a metal sleeve by locally deforming the sleeve and by depressing it in a hole in the insulator body. According to this publication, the depressions in the metal sleeve are provided substantially at the center of side faces. It has been found that the insulator body is enclosed thereby, it is true, but also that the insulator body is not immovably held thereby. This known lamp cap therefore has the disadvantage that in a lamp capped therewith, mechanical forces can again be exerted on the connection between a current supply conductor and the contact member. The non-rigid coupling between the metal sleeve and the insulator body in this known lamp cap is due to the fact that the metal cylinder is plastically deformed only in part and is elastically deformed for too large a part when the depressions are formed. Thus, as soon as the tool by means of which each depression is formed is removed, the metal sleeve springs back towards its original position to such an extent that a coupling permitting relative movement between the sleeve and insulator body is obtained.

In the lamp according to the invention, the depressions are formed in corners of the metal sleeve. The sleeve has a very high degree of rigidity at its corners. The deformation of the sleeve at the area of the corners during the formation of depressions is therefore mainly a plastic deformation, as a result of which an immovable coupling is obtained.

It has been found that depressions which are V-shaped in a cross-section which is in a plane through the relevant corner are very advantageous and can readily be obtained.

In a lamp according to the invention, the second current supply conductor can be secured in an electrically conducting manner to the metal sleeve, in which event the lamp can be used as a car headlamp, or it can be secured to a cable, in which event the lamp can be used for air-port illumination. In the car headlamp, both current supply conductors can pass through the same pinch or can each pass through an individual pinch. In the latter case, the second current supply conductor extends to the lamp cap along the outer surface of the lamp vessel. Also in the air-port illumination lamp, each current supply conductor often passes through an individual pinch.

The lamp according to the invention can comprise a halogen-containing gas filling and a lamp vessel having an $SiO_2$ content of more than 95% by weight.

An embodiment of the lamp according to the invention will now be described, by way of example, with reference to the accompanying drawing.

FIG. 1 of the drawing shows the lamp in side elevation.

Figure 2:
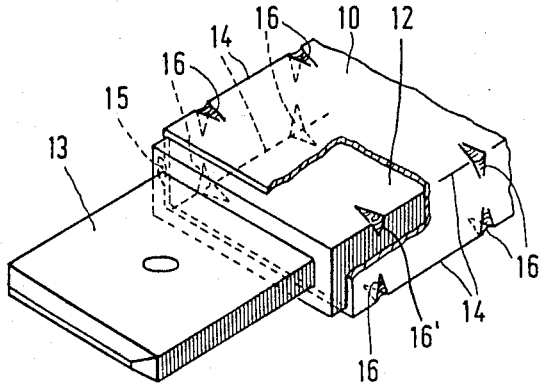

FIG. 2 of the drawing shows an enlarged, perspective view of the left hand side of the lamp shown in FIG. 1.

In FIG. 1, a quartz glass lamp vessel is sealed in a vacuum-tight manner and filled with a halogen-containing gas. A filament 2 is arranged therein as an electric element which is connected to a first and a second current supply conductor 4 and 5 respectively.

The lamp vessel 1 has a pinch 3, which is fixed in a metal sleeve 10 of substantially rectangular cross-section. The metal sleeve 10 is closed in longitudinal direction by a folding seam 15. Inwardly projecting lugs 11 clamp the pinch 3 holding the lamp vessel 1 tightly on the metal sleeve 10. Both current supply conductors 4 and 5 pass through the pinch 3.

The metal sleeve 10 accommodates an insulator body 12 having a substantially rectangular cross-section, in which a contact member 13 is immovably fixed over part of its length. The insulator body 12 may consist, for example, of synthetic material and may be formed by molding its raw material around the contact member 13. The connection terminal of a current source (not shown) is secured to the contact member 13, which projects both from one end from the insulator body 12 and from the metal sleeve 10. Through an opening 17 in the metal sleeve 10, the first current supply conductor 4 is welded to the contact member 13. The second current supply conductor 5 is welded to a stamped tongue 18 of the metal sleeve 10.

The metal sleeve 10 is obtained from a metal sheet, which is bent about four fold lines 14. It is folded about the pinch 3 of the lamp vessel 1 in a clamping manner and is closed by means of the folding seam 15. The fold lines 14 form the corners of the sleeve 10 forming a substantially rectangular cross-section.

As shown in FIG. 2, the corners 14 are provided with depressions 16 engaging similarly shaped recesses 16' in the insulator body 12. As a result of the engagement of depressions 16 and recesses 16', the insulator body 12 is immovably fixed in the metal sleeve 10. The welding connection between the first current supply conductor 4 and the contact member 13 cannot be mechanically loaded when a connection terminal is provided on this contact member 13.

A centering ring, which, for the sake of clarity, is not shown in the drawing, for use in conjunction with the lamp cap to secure the lamp cap mechanically in a lamp holder is arranged to surround the metal sleeve 10, and welded thereto.

What is claimed is:

1. In a capped electric lamp comprising:

(a) a lamp vessel sealed in a vacuum-tight manner having an electric element arranged therein and having a pinch;

(b) a first and second current supply conductor, each conductor extending from the outside of said lamp vessel to said electric element, at least one conductor passing through said pinch;

(c) a metal sleeve having a substantially rectangular cross-section, said pinch of said lamp vessel being firmly fixed therein, said sleeve having a plurality of corners formed by intersections of respective planes of the sleeve;

(d) an insulator body having a substantially rectangular cross-section, said insulator body enclosed in said metal sleeve; and (e) a contact member connected to said first current supply conductor, said contact member being immovably enclosed at least partially over its length by said insulator body and having one of its ends projecting from said insulator body and said metal sleeve;

the improvement therein comprising said insulator body being immovably held in said metal sleeve by at least one depression in at least one corner of said metal sleeve, said depression engaging a recess of said insulator body, and said depression being mainly a plastic deformation.

2. A capped electric lamp as claimed in claim 1, wherein a plurality of corners of said metal sleeve each have at least one said depression respectively, each depression engaging an associated recess of said insulator body.

3. A capped electric lamp as claimed in claim 1, wherein at least one corner of said metal sleeve has a plurality of said depressions, each depression engaging an associated recess in said insulator body.

4. In a capped electric lamp comprising:

(a) a lamp vessel sealed in a vacuum-tight manner having an electric element arranged therein and having a pinch;

(b) a first and second current supply conductor, each conductor extending from the outside of said lamp vessel to said electric element, at least one conductor passing through said pinch;

(c) a metal sleeve having a substantially polygonal cross-section, said pinch of said lamp vessel being firmly fixed therein, said sleeve having a plurality of corners formed by intersections of respective planes of the sleeve;

(d) an insulator body having a substantially polygonal cross-section, said insulator body enclosed in said metal sleeve; and (e) a contact member connected to said first current supply conductor, said contact member being immovably enclosed at least partially over its length by said insulator body and having one of its ends projecting from said insulator body and said metal sleeve;

the improvement therein in which a plurality of said corners have at least one respective depression formed in said sleeve;

said insulator body has a plurality of recesses formed therein, said recesses being located at least at respective corners of said body, and said body is immovably held in said metal sleeve by engagement of each of said depressions in an associated recess of said insulator body, each said depression being mainly a plastic deformation.

5. In a capped electric lamp comprising:

(a) a lamp vessel sealed in a vacuum-tight manner having an electric element arranged therein and having a pinch;

(b) a first and second current supply conductor, each conductor extending from the outside of said lamp vessel to said electric element, at least one conductor passing through said pinch;

(c) a metal sleeve having a substantially rectangular cross-section, and four corners formed by intersections of respective planes of the sleeve, said pinch of said lamp vessel being firmly fixed in said sleeve;

(d) an insulator body having a substantially rectangular cross-section, said insulator body enclosed in said metal sleeve; and (e) a contact member connected to said first current supply conductor, said contact member being immovably enclosed at least partially over its length by said insulator body and having one of its ends projecting from said insulating body and said metal sleeve;

the improvement therein in which each of said corners has at least one respective depression formed in said sleeve;

said insulator body has a plurality of recesses formed therein, said recesses being located at least at respective corners of said body, and said body is immovably held in said metal sleeve by engagement of each of said depressions in an associated recess of said insulator body, each said depression being mainly a plastic deformation.

6. A capped lamp as claimed in claim 5, wherein each of said corners of said metal sleeve comprises two depressions.

7. A capped lamp as claimed in claim 5, wherein said depressions are V-shaped.

* * * * *